US010836055B2

(12) United States Patent
Su

(10) Patent No.: US 10,836,055 B2
(45) Date of Patent: Nov. 17, 2020

(54) SCRAPER

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 0 days.

(21) Appl. No.: 16/571,334

(22) Filed: Sep. 16, 2019

(65) Prior Publication Data

US 2020/0108516 A1 Apr. 9, 2020

(30) Foreign Application Priority Data

Oct. 4, 2018 (TW) ..... 107135083 A

(51) Int. Cl.
*B26B 5/00* (2006.01)
*A47L 13/022* (2006.01)
*B44D 3/16* (2006.01)

(52) U.S. Cl.
CPC ..... *B26B 5/006* (2013.01); *A47L 13/022* (2013.01); *B44D 3/164* (2013.01)

(58) Field of Classification Search
CPC .. B26B 5/00; B26B 5/006; B25G 3/20; B25G 3/24; B44D 3/162; B44D 3/164; A47L 13/00; A47L 13/02; A47L 13/022; A47L 13/08
USPC ..... 30/169–172, 329–331; D32/46; 29/81.17; 15/236.01–236.1, 93.1
See application file for complete search history.

(56) References Cited

U.S. PATENT DOCUMENTS 403,625 A * 5/1889 Thompson ..... A47L 1/08 30/169
870,877 A * 11/1907 Fleming ..... B26B 5/006 30/169
1,418,189 A * 5/1922 Kimball ..... B44D 3/162 30/169
1,726,017 A * 8/1929 Des Enfants, Sr. .... B44D 3/162 15/236.01
2,042,273 A * 5/1936 Okun ..... B27G 17/04 30/171

(Continued)

FOREIGN PATENT DOCUMENTS

TW 506434 U 10/2002

*Primary Examiner* — Jason Daniel Prone
(74) *Attorney, Agent, or Firm* — Alan D. Kamrath; Mayer & Williams PC

(57) ABSTRACT

A scraper includes a body having a handle portion, a first clamping portion, and a second clamping portion. The first clamping portion and the second clamping portion integrally extends from an end of the handle portion. The second clamping portion is pivotable relative to the first clamping portion. The second clamping portion includes a first coupling member disengageably engaged with the first clamping portion. The first coupling member is configured to flex when subjected to a force, thereby disengaging from the first clamping portion. A control member is disposed on the first clamping portion and is configured to flex when subjected to force. Flexing of the control member pushes the first coupling member to thereby disengage the first coupling member from the first clamping portion. A blade is removably mounted between the first clamping portion and the second clamping portion.

8 Claims, 6 Drawing Sheets

(56) References Cited

U.S. PATENT DOCUMENTS 2,610,401 A * 9/1952 Vosbikian et al. ..... B26B 5/006 30/169
3,430,339 A * 3/1969 Hobson ..... B26B 27/00 30/329
3,530,578 A * 9/1970 Katz ..... B44D 3/162 30/171
3,670,414 A * 6/1972 Stecker ..... B44D 3/164 15/236.01
4,612,707 A * 9/1986 Shea ..... B26B 5/00 30/169
4,955,138 A * 9/1990 Henke ..... A47L 13/08 15/236.01
4,979,300 A * 12/1990 Blank ..... B26B 5/00 30/169
5,208,984 A * 5/1993 Negus ..... B44D 3/164 15/236.01
RE34,979 E * 6/1995 Gringer ..... B26B 5/00 30/169
5,528,832 A * 6/1996 Schmidt ..... B26B 5/001 30/169
6,308,418 B1 * 10/2001 Sweet ..... B26B 5/001 30/169
6,334,254 B1 * 1/2002 Wonderley ..... B44D 3/164 30/169
6,519,801 B1 * 2/2003 Chao ..... B44D 3/164 15/236.01
D586,512 S * 2/2009 van Deursen ..... D32/46
D587,871 S * 3/2009 van Deursen ..... D32/46
D592,370 S * 5/2009 van Deursen ..... D32/46
D624,262 S * 9/2010 Gringer ..... D32/46
7,814,608 B1 10/2010 Catello
D627,942 S * 11/2010 Chiu ..... D32/48
7,930,831 B2 * 4/2011 Lin ..... B44D 3/164 30/169
8,171,646 B2 * 5/2012 Chiu ..... A47L 13/08 30/169
8,356,415 B2 * 1/2013 Lin ..... A47L 13/08 15/236.01
8,726,966 B1 * 5/2014 Liao ..... B44C 7/027 30/172
8,978,257 B2 * 3/2015 Quimby ..... B26B 5/00 30/329
2004/0000056 A1 * 1/2004 Chao ..... B44D 3/162 30/169
2004/0143924 A1 * 7/2004 Salmon ..... B26B 5/00 15/236.1
2005/0120564 A1 * 6/2005 Chen Lin ..... B26B 5/001 30/169
2007/0294850 A1 * 12/2007 Murphy ..... B25G 3/24 15/236.01
2009/0188116 A1 * 7/2009 van Deursen ..... A47L 13/08 30/170
2009/0199411 A1 * 8/2009 van Deursen ..... A47L 13/08 30/169
2009/0235535 A1 9/2009 Circosta et al.
2011/0030224 A1 * 2/2011 Wang ..... E04F 21/32 30/169
2011/0138566 A1 * 6/2011 Wang ..... B26B 5/00 15/236.01
2014/0230254 A1 * 8/2014 Wu ..... B26B 5/00 30/169
2015/0026986 A1 * 1/2015 Berglund ..... A47L 13/022 30/172
2015/0305584 A1 * 10/2015 Sgroi, Jr. ..... A47L 13/022 15/236.01
2016/0106289 A1 * 4/2016 Willis ..... A47L 13/08 15/236.01
2019/0134831 A1 * 5/2019 Chiu ..... B26B 5/006

* cited by examiner

SCRAPER

BACKGROUND OF THE INVENTION

The present invention relates to a scraper and, more particularly, to a scraper permitting replacement of a blade while having a simple structure.

Conventional scrapers generally include a body, a blade pressing board, and a protrusive block. The blade pressing board includes a coupling groove for coupling with the protrusive block, thereby mounting the blade pressing board to the body. Furthermore, a knob is disposed on the body for pressing against the blade pressing board. Thus, a blade can be clamped between the body and the blade pressing board, and the knob presses against the blade pressing board. Furthermore, the coupling section between the protrusive block and the coupling groove serves as a fulcrum to provide the blade with an appropriate clamping force. An example of such a scraper structure is disclosed in Taiwan Patent Publication No. 506434.

However, in assembly of the above conventional scraper structure, the blade must be firstly placed between the body and the blade pressing board before tightening the knob. The assembly is time-consuming. Furthermore, the knob is exposed outside of the body, resulting in a larger volume which is inconvenient for carriage and storage as well as having an unaesthetic shape.

Thus, a need exists for a novel scraper that mitigates and/or obviates the above disadvantages.

BRIEF SUMMARY OF THE INVENTION

An objective of the present invention is to provide a scraper permitting replacement of a blade and permitting rapid assembly through a simple structure.

A scraper according to the present invention includes a body having a handle portion, a first clamping portion, and a second clamping portion. The first clamping portion and the second clamping portion integrally extends from an end of the handle portion. The second clamping portion is pivotable relative to the first clamping portion. The second clamping portion includes a first coupling member disengageably engaged with the first clamping portion. The first coupling member is configured to flex when subjected to a force, thereby disengaging from the first clamping portion. A control member is disposed on the first clamping portion and is configured to flex when subjected to force. Flexing of the control member pushes the first coupling member to thereby disengage the first coupling member from the first clamping portion. A blade is removably mounted between the first clamping portion and the second clamping portion.

In an example, the first clamping portion includes a slot and a groove intercommunicating with the slot. The first coupling member extends towards the first clamping portion and extends through the slot to disengageably engage with the first clamping portion. The control member is disposed in the groove.

In an example, the first clamping portion includes two sidewalls and a first side hole. The groove is located between the two sidewalls. The first side hole extends through one of the two sidewalls. The control member includes an intermediate portion and a first wing integrally formed on an end of the intermediate portion. The first wing is configured to flex relative to the intermediate portion when subjected to force. The first wing includes a pushing section and a pressing section. When the first wing is subjected to force, the pushing section of the first wing flexes relative to the intermediate portion to push the first coupling member to disengage from the first clamping portion. The pressing section of the first wing extends through the first side hole and is exposed outside of the first clamping portion.

In an example, the second clamping portion further includes a second coupling member parallel to the first coupling member. The second coupling member extends through the slot to disengagably engage with the first clamping portion. A second side hole extends through another of the two sidewalls. The control member further includes a second wing integrally formed on another end of the intermediate portion. The second wing is configured to flex relative to the intermediate portion when subjected to force. The second wing includes a pushing section and a pressing section. The pushing section of the second wing is configured to flex relative to the intermediate portion to thereby push the second coupling member. The pressing section of the second wing extends through the second side hole and is exposed outside of the first clamping portion.

In an example, the control member has U-shaped cross sections.

In an example, the first clamping portion includes a limiting block located in the groove. The limiting block is located between the intermediate portion and the first and second wings. The first and second coupling members are located on two sides of the limiting block.

In an example, the body and the control member are made of plastic material.

In an example, the scraper further includes a cap detachably coupled to the first clamping portion and the second clamping portion.

In an example of the scraper according to the present invention, the two clamping members of the second clamping portion originally coupled with the first clamping portion flex to disengage from the first clamping portion when subjected to force from the pushing sections. Thus, the second clamping portion can pivot relative to the first clamping portion to permit replacement or installation of the blade. In assembly, the blade can be placed between the first clamping portion and the second clamping portion. Then, the second clamping portion is pressed to engage the two coupling members of the second clamping portion with the first clamping portion, accomplishing the assembly.

The present invention will become clearer in light of the following detailed description of illustrative embodiments of this invention described in connection with the drawings.

DETAILED DESCRIPTION OF THE INVENTION

Figure 1:
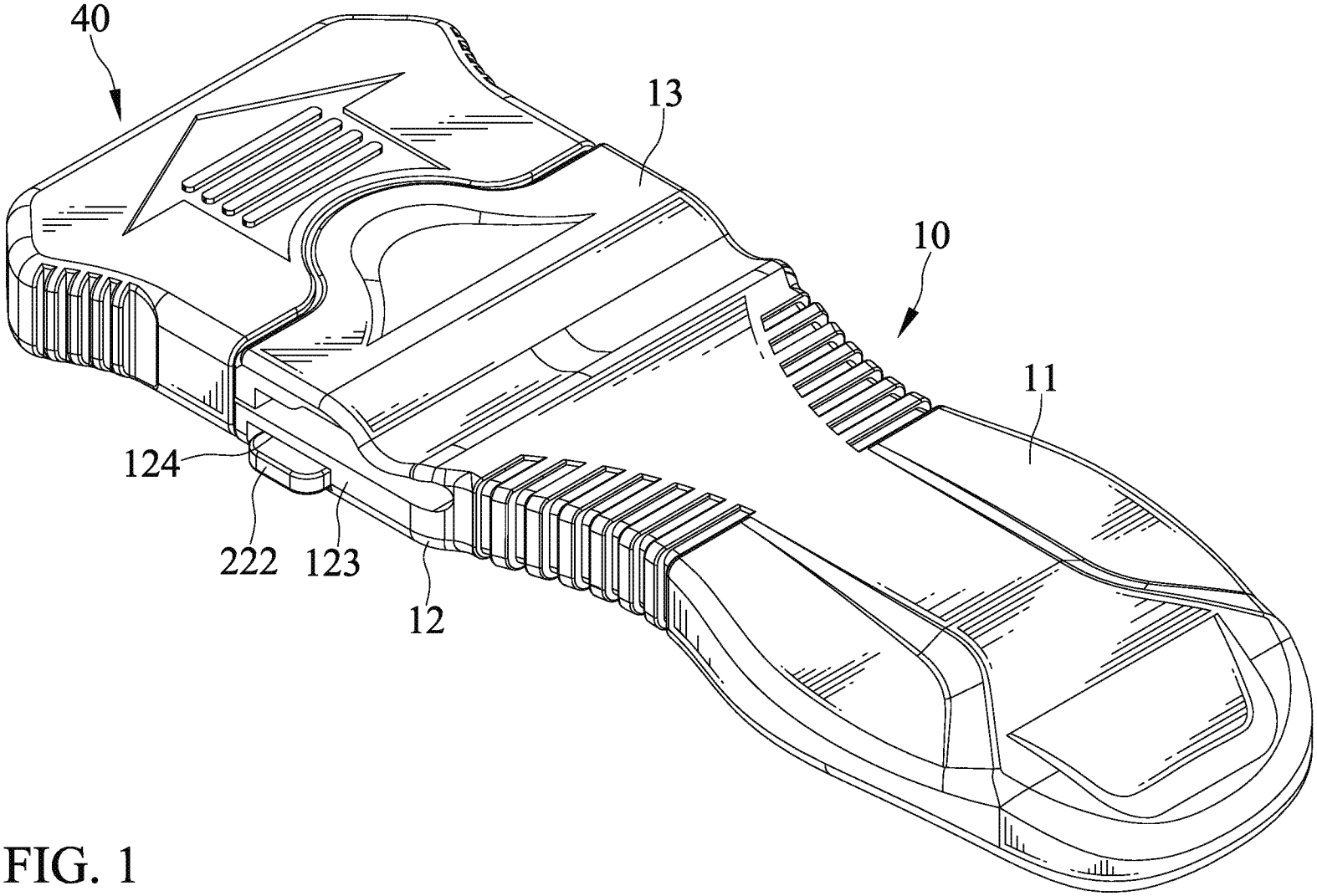
FIG. 1 is a perspective view of a scraper of an embodiment according to the present invention.
Figure 2:
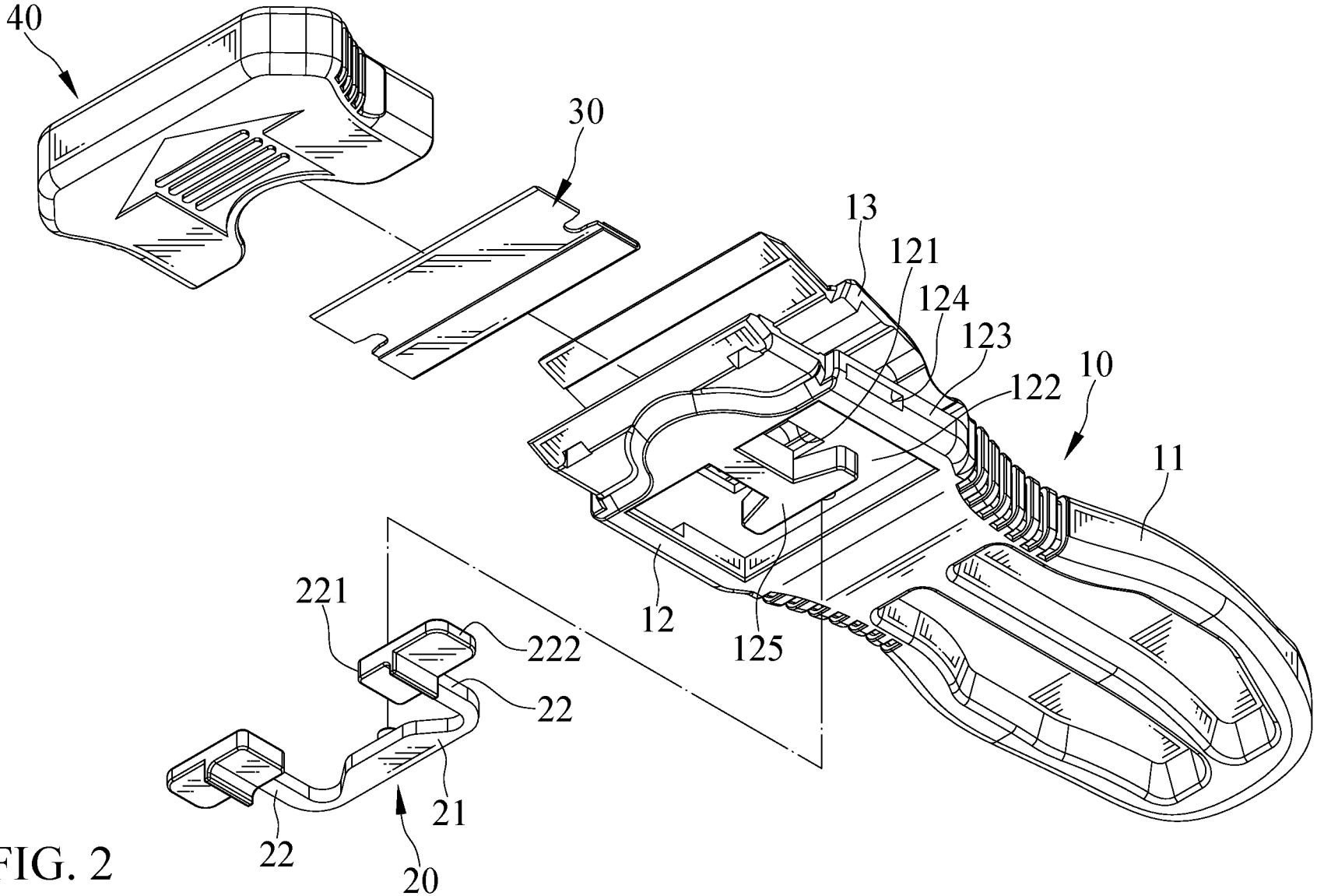
FIG. 2 is an exploded, perspective view of the scraper of FIG. 1.
Figure 3:
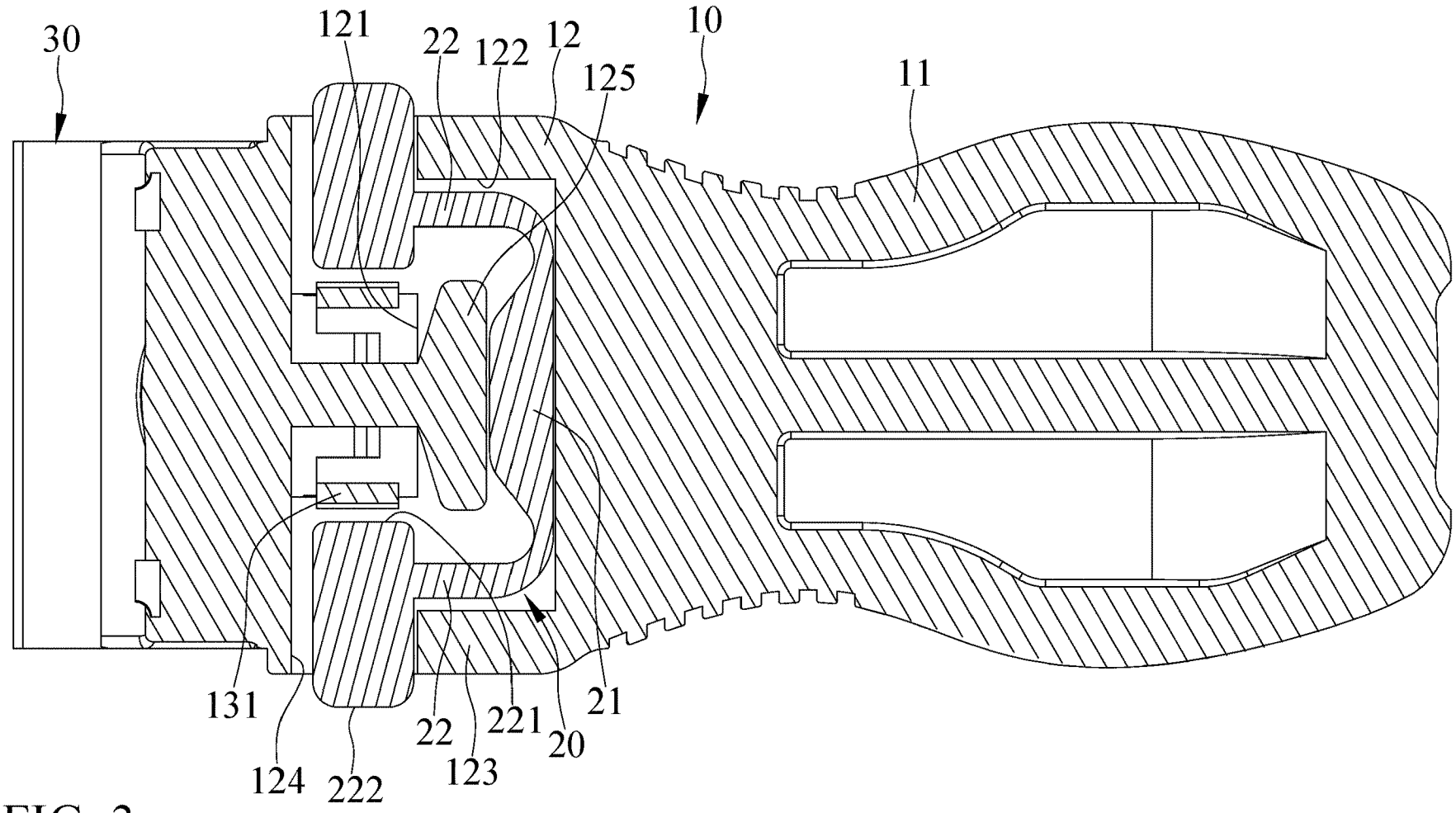
FIG. 3 is a cross sectional view of the scraper of FIG. 1.
Figure 4:
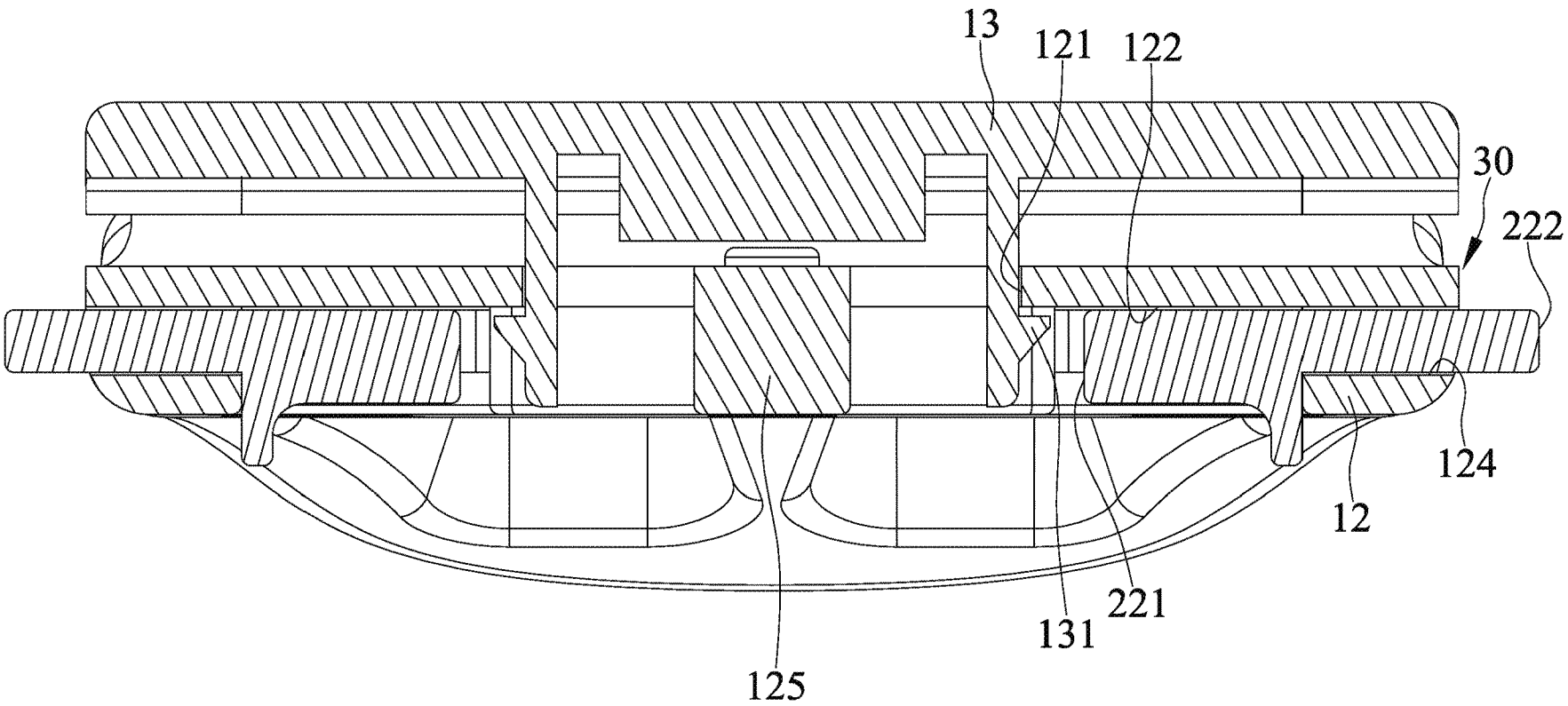
FIG. 4 is another cross sectional view of the scraper of FIG. 1.

With reference to FIGS. 1-6, a scraper of an embodiment according to the present invention includes a body 10, a control member 20, a blade 30, and a cap 40. The body 10 includes a handle portion 11, a first clamping portion 12, and a second clamping portion 13. Both the first clamping portion 12 and the second clamping portion 13 integrally extend from an end of the handle portion 11. The second clamping portion 13 is pivotable relative to the first clamping portion 12. The first clamping portion 12 includes a slot 121, a groove 122, two sidewalls 123, at least one side hole 124, and a limiting block 125. The slot 121 intercommunicates with the groove 122. The groove 122 is located between the two sidewalls 123. The at least one side hole 124 extends through one of the two sidewalls 123. The limiting block 125 is located in the groove 122. The second clamping portion 13 includes at least one coupling member 131 extending towards the first clamping portion 122 and extending through the slot 121. The at least one coupling member 131 disengageably engages with an edge of the slot 121 of the first clamping portion 12 (see FIG. 4). The at least one coupling member 131 is configured to flex when subjected to a force, thereby disengaging from the first clamping portion 12.

The control member 20 is disposed in the groove 122 of the first clamping portion 12. The control member 20 includes an intermediate portion 21 and at least one wing 22 integrally formed on an end of the intermediate portion 21. The at least one wing 22 is configured to flex relative to the intermediate portion 21 when subjected to force. The at least one wing 22 includes a pushing section 221 and a pressing section 222. When the at least one wing 22 is subjected to force, the pushing section 221 flexes relative to the intermediate portion 21 to push the at least one coupling member 131, such that the at least one coupling member 131 flexes and disengages from the first clamping portion 12. The pressing section 222 extends through the at least one side hole 124 and is exposed outside of the first clamping portion 12. Thus, a user can press the pressing section 222, and the at least one wing 22 subjected to force flexes relative to the intermediate portion 21, causing the pushing section 221 to push the at least one pressing member 131.

In this embodiment, both the body 10 and the control member 20 are made of plastic material. The second clamping portion 13 includes two coupling members 131 that are integrally formed with the second clamping portion 13 and that are parallel to each other. The two coupling members 131 respectively face two sides of the limiting block 125. Furthermore, the two coupling members 131 extend through the slot 121 and disengageably engages with the first clamping portion 12. The first clamping portion 12 includes two side holes 124 respectively extending through the two sidewalls 123. The control member 20 includes two wings 22 integrally formed on two opposite ends of the intermediate portion 21, such that the control member 20 has substantially U-shaped cross sections. Furthermore, the limiting block 125 is located between the intermediate portion 21 and the two wings 22. The pressing sections 222 of the two wings 22 respectively extend through the two side holes 124 to expose outside of the two sidewalls 123 of the first clamping portion 12.

The blade 30 is removably mounted between the first clamping portion 12 and the second clamping portion 13. The cap 40 is detachably coupled to the first clamping portion 12 and the second clamping portion 13.

Figure 5:
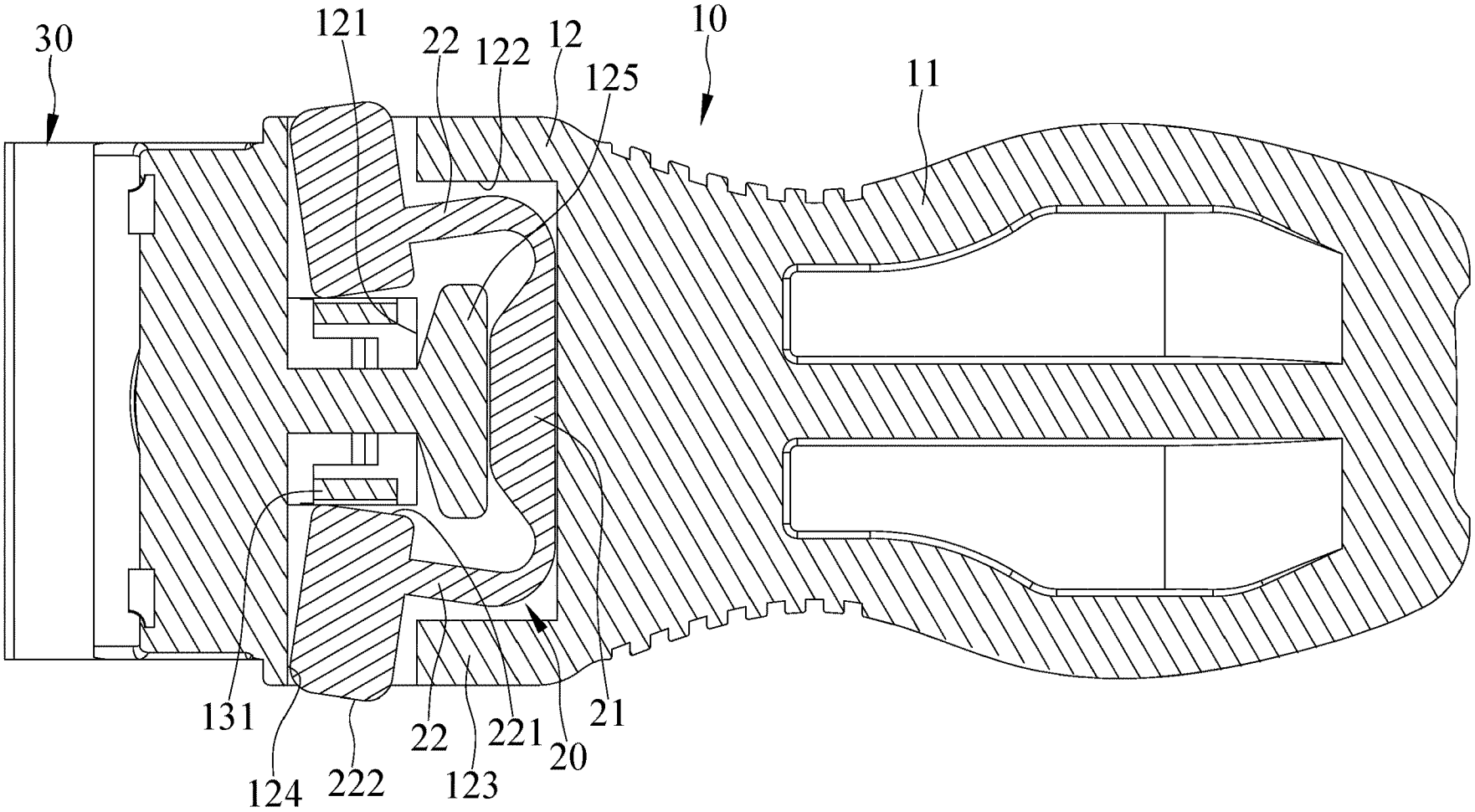
FIG. 5 is a view similar to FIG. 3 with a control member pressing against two coupling members.
Figure 6:
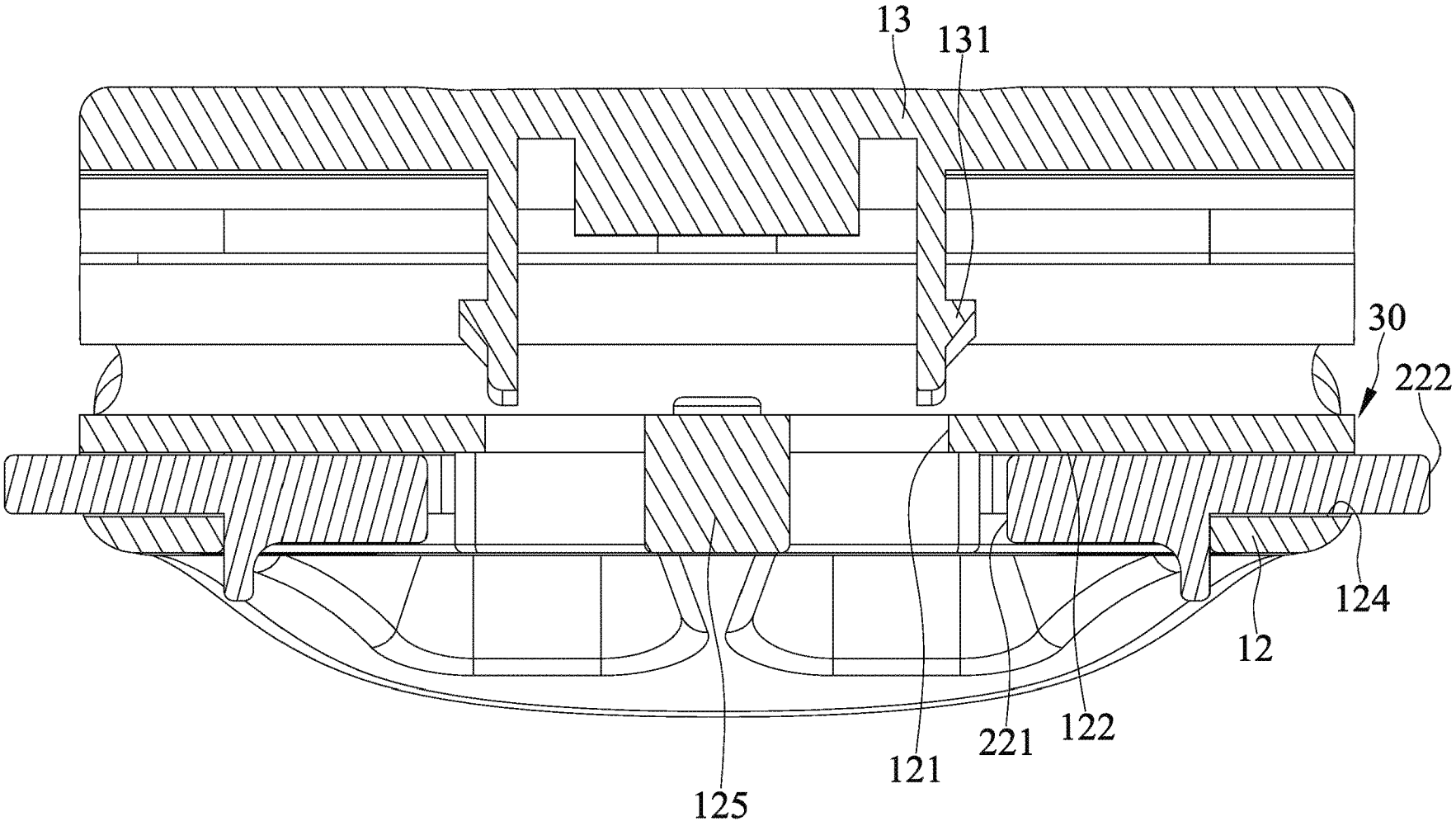
FIG. 6 is a view similar to FIG. 4 with the two coupling members disengaged from a first clamping portion.

With reference to FIGS. 5 and 6, the user can press the pressing sections 222 to flex the two wings 22 relative to the intermediate portion 21, such that the pushing sections 221 push the two coupling members 131. The two coupling members 131 pushed by the pushing sections 221 flex and disengage from the first clamping portion 12. After the two coupling members 131 disengage from two edges of the slot 121 of the first clamping portion 12, the second clamping portion 13 can pivot relative to the first clamping portion 12 to permit replacement or installation of the blade 30.

When it is desired to assemble or install the blade 30, the user places the blade 30 between the first clamping portion 12 and the second clamping portion 13. Then, the second clamping portion 13 is pressed to extend the two coupling members 131 of the second clamping portion 13 through the slot 121 to thereby couple with the two edges of the slot 121 of the first clamping portion 12, accomplishing the assembly. Rapid assembly is, thus, achieved.

In view of the foregoing, in the scraper according to the present invention, the two clamping members 131 of the second clamping portion 13 originally coupled with the first clamping portion 12 flex to disengage from the first clamping portion 12 when subjected to force from the pushing sections 221. Thus, the second clamping portion 13 can pivot relative to the first clamping portion 12 to permit replacement or installation of the blade 30. In assembly, the blade 30 can be placed between the first clamping portion 12 and the second clamping portion 13. Then, the second clamping portion 13 is pressed to engage the two coupling members 131 of the second clamping portion 13 with the first clamping portion 12, accomplishing the assembly.

Although specific embodiments have been illustrated and described, numerous modifications and variations are still possible without departing from the scope of the invention. The scope of the invention is limited by the accompanying claims.

The invention claimed is:

1. A scraper comprising:

a body including a handle portion, a first clamping portion, and a second clamping portion, wherein the first clamping portion and the second clamping portion integrally extends from an end of the handle portion, wherein the second clamping portion is pivotable relative to the first clamping portion, wherein the second clamping portion includes a first coupling member disengageably engaged with the first clamping portion, and wherein the first coupling member is configured to flex when subjected to a force, thereby disengaging from the first clamping portion;

a control member disposed on the first clamping portion, wherein the control member is configured to flex when subjected to force, wherein flexing of the control member pushes the first coupling member to thereby disengage the first coupling member from the first clamping portion; and a blade removably mounted between the first clamping portion and the second clamping portion.

2. The scraper as claimed in claim 1, wherein the first clamping portion includes a slot and a groove intercommunicating with the slot, wherein the first coupling member extends towards the first clamping portion and extends through the slot to disengageably engage with the first clamping portion, and wherein the control member is disposed in the groove.

3. The scraper as claimed in claim 2, wherein the first clamping portion includes two sidewalls and a first side hole, wherein the groove is located between the two sidewalls, wherein the first side hole extends through one of the two sidewalls, wherein the control member includes an intermediate portion and a first wing integrally formed on an end of the intermediate portion, wherein the first wing is configured to flex relative to the intermediate portion when subjected to force, wherein the first wing includes a pushing section and a pressing section, wherein when the first wing is subjected to force, the pushing section of the first wing flexes relative to the intermediate portion to push the first coupling member to disengage from the first clamping portion, and wherein the pressing section of the first wing extends through the first side hole and is exposed outside of the first clamping portion.

4. The scraper as claimed in claim 3, wherein the second clamping portion further includes a second coupling member parallel to the first coupling member, wherein the second coupling member extends through the slot to disengagably engage with the first clamping portion, wherein a second side hole extends through another of the two sidewalls, wherein the control member further includes a second wing integrally formed on another end of the intermediate portion, wherein the second wing is configured to flex relative to the intermediate portion when subjected to force, wherein the second wing includes a pushing section and a pressing section, wherein the pushing section of the second wing is configured to flex relative to the intermediate portion to thereby push the second coupling member, and wherein the pressing section of the second wing extends through the second side hole and is exposed outside of the first clamping portion.

5. The scraper as claimed in claim 4, wherein the control member has U-shaped cross sections.

6. The scraper as claimed in claim 4, wherein the first clamping portion includes a limiting block located in the groove, wherein the limiting block is located between the intermediate portion and the first and second wings, and wherein the first and second coupling members are located on two sides of the limiting block.

7. The scraper as claimed in claim 4, wherein the body and the control member are made of plastic material.

8. The scraper as claimed in claim 1, further comprising a cap detachably coupled to the first clamping portion and the second clamping portion.

* * * * *